US005624306A

United States Patent [19]

Casillas et al.

[11] Patent Number: 5,624,306

[45] Date of Patent: Apr. 29, 1997

[54] STACKED SANDING WHEEL FOR RADICAL PROFILES

[75] Inventors: Abel R. Casillas, Los Angeles; Jose R. Gutierrez, Long Beach; Frederick C. Schneider, III, Palos Verdes Estates, all of Calif.

[73] Assignee: Visser Irrevocable Trust 1992-1, Englewood, Colo.

[21] Appl. No.: 323,353

[22] Filed: Oct. 14, 1994

Related U.S. Application Data

[63] Continuation-in-part of Ser. No. 157,886, Nov. 23, 1993, Pat. No. 5,394,652.

[51] Int. Cl.[6] ..... B24B 9/18

[52] U.S. Cl. ..... 451/358; 451/498; 451/544

[58] Field of Search ..... 451/461, 353, 451/344, 490, 496, 497, 498, 508, 510, 521, 545, 544

[56] References Cited

U.S. PATENT DOCUMENTS

| | | | |
|---|---|---|---|
| 1,072,620 | 9/1913 | Klay | 451/461 |
| 1,089,247 | 3/1914 | Menyhert et al. | 451/461 |
| 1,795,702 | 3/1931 | Barton | 51/366 |
| 2,120,624 | 6/1938 | Pearson | 51/364 |
| 2,257,061 | 9/1941 | Morris | 51/364 |
| 2,265,581 | 12/1941 | Stahl | 51/364 |
| 2,432,753 | 12/1947 | McGriffin | 51/208 |
| 2,494,818 | 1/1950 | Kristek | 51/364 |
| 2,720,064 | 10/1955 | Klug | 51/365 |
| 2,741,073 | 4/1956 | Schwabe | 51/128 |
| 2,778,167 | 1/1957 | Klumpp | 51/364 |
| 2,900,768 | 8/1959 | MacFarland | 451/510 |
| 2,993,312 | 7/1961 | Holland et al. | 51/210 |
| 3,517,462 | 6/1970 | Imhof | 51/128 |
| 4,053,288 | 10/1977 | Barron, Sr. | 51/128 |
| 4,322,915 | 4/1982 | Kindig | 51/128 |
| 4,437,269 | 3/1984 | Shaw | 51/407 |
| 4,606,154 | 8/1986 | Hermann | 51/401 |
| 4,744,180 | 5/1988 | Voorhees | 51/358 |
| 4,870,787 | 10/1989 | Voorhees | 51/358 |
| 5,380,239 | 1/1995 | Casillas et al. | 451/498 |

FOREIGN PATENT DOCUMENTS

| | | | |
|---|---|---|---|
| 1316118 | 12/1962 | France . | |
| 187224 | 4/1905 | Germany . | |
| 0245422 | 4/1912 | Germany | 451/461 |
| 450529 | 9/1927 | Germany | 51/366 |
| 356890 | 8/1992 | Germany | 51/364 |

OTHER PUBLICATIONS

Brochure of Larick Machinery, Inc. (c.1990).
Brochure of Arminius (c.1990)
Brochure of Fast Technological Development (c.1990).
Brochure of Fletcher Machine, Inc. (c.1990).
Brochure of Voorwood (c.1990).
Brochure of Nicolas Industries (c.1990).
Brochure of Reckmann (c.1990).
Brochure of Shimura Iron Works Co., Ltd. (c.1990).
3 Sheets of Drawings of an Earlier Sanding Wheel of Assignee c.1992.

*Primary Examiner*—Robert A. Rose
*Attorney, Agent, or Firm*—W. Scott Carson

[57] ABSTRACT

A stacked sanding wheel for wooden panels with radical profiles. The sanding wheel has two sanding members stacked atop one another and mounted to a drive means for rotation about an axis. Each sanding member has a relatively rigid backing portion with an outer surface corresponding in profile to one of the surfaces on each side of the profile edge. The flexible sanding strips assume the shape of the outer surface of each backing portion which, in turn, corresponds to one of the surfaces of the profile to be sanded. The separate sanding members are secured to the drive means in a stacked relationship with their separate sanding strips abutting one another to form a sharp edge corresponding to the sharp edge of the wooden panel's profile.

22 Claims, 5 Drawing Sheets

Fig. 4
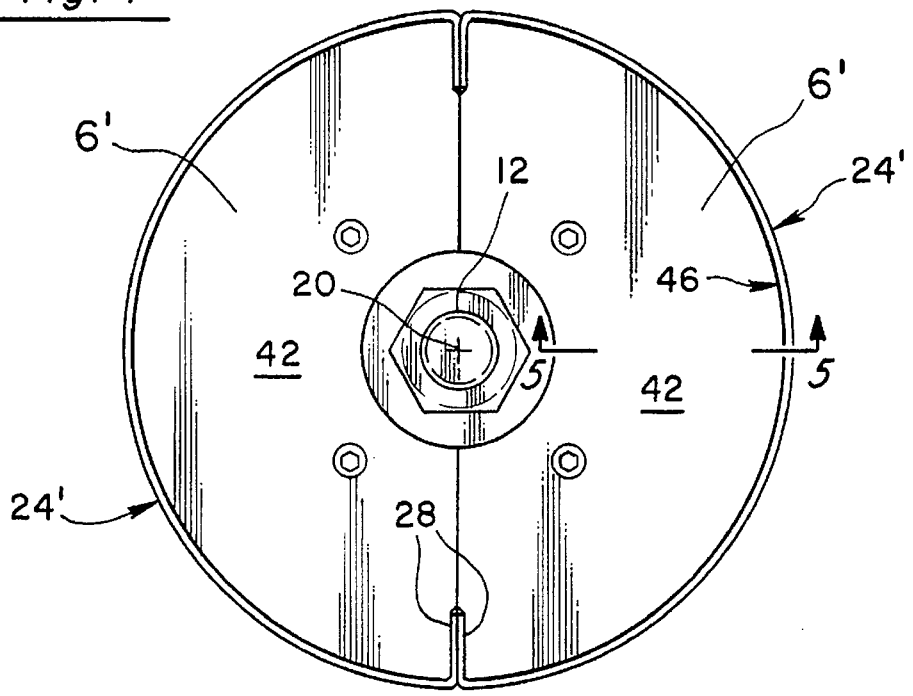
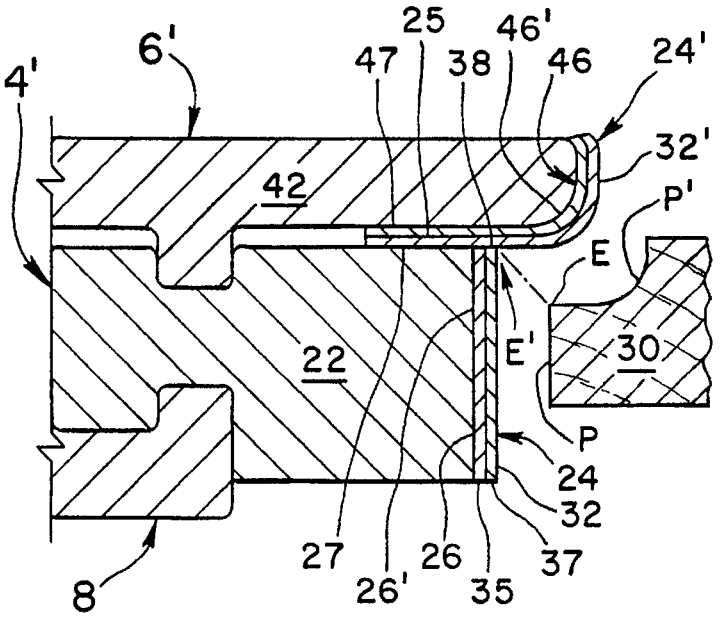
Fig. 5
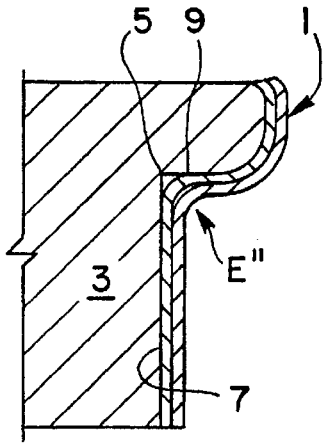
Fig. 6
(Prior Art)

STACKED SANDING WHEEL FOR RADICAL PROFILES

RELATED APPLICATIONS

This application is a continuation-in-part of U.S. patent application Ser. No. 157,886 filed Nov. 23, 1993, now U.S. Pat. No. 5,394,652.

BACKGROUND OF THE INVENTION

1. Field of the Invention

This invention relates to the field of sanding apparatus and more particularly, to the field of sanding wheels for radical profiles.

2. Discussion of the Background

Wooden panels with a sharp edge in their profiles present difficult sanding problems. Commonly, these radical profiles are rough cut by shaping or coping heads and include angled surfaces meeting to form a sharp edge. In the sanding operation, the problem is then presented of how to sand the profile without ruining or dulling the sharp edge and putting an undesirable radius or curve in it.

Presently, such profiles with sharp edges in them are sanded by either doing multiple passes of the panel by the sanders (wherein only one surface on each side of the edge is sanded with each pass) or having a special, one-piece sanding wheel custom made. The first approach of having to do multiple passes is time consuming. The second approach of having a special, one-piece wheel made is expensive. Typically, such wheels are custom cast is plastic with the desired profile and then sprayed with an adhesive glue and abrasive particles. The problem subsequently arises that when the adhesive wears out, it is very difficult and time consuming to reapply new abrasive and often, it is necessary to replace the entire wheel with a new, custom-made one.

In general sanding operations, a currently popular and relatively inexpensive design for sanding wheels involves using removable sanding strips which are fastened to profiled backing portions (e.g., by hook-loop arrangements). Such strips can be easily and quickly removed and replaced as they wear out and are relatively inexpensive. Unfortunately, to date, such wheels with removable sanding strips could not be used to sand radical profiles such as ones with a sharp, linear edge in them. The problem is that although such radical profiles can be created in the rigid backing portion (e.g., metal), the removable sanding strip could not be bent (see FIG. 6) or pushed into the sharp angle of the radical edge on the backing portion. Rather, the strip would end up curving (see FIG. 6) across the angle of the edge in the backing portion and dulling or putting an undesirable radius or curve on the edge of the wooden panel or other workpiece.

In this light, the modified sanding wheel of the present invention was developed. With it, radical or sharp edged profiles can be quickly and easily sanded using sanding wheels with relatively inexpensive and easily removable and replaceable sanding strips.

SUMMARY OF THE INVENTION

This invention involves a stacked sanding wheel for wooden panels with radical profiles. Such profiles typically have angled surfaces that meet to form a relatively sharp edge. The sanding wheel has two sanding members stacked atop one another and mounted to a drive means for rotation about an axis. Each sanding member has a relatively rigid backing portion with an outer surface corresponding in profile to one of the surfaces on each side of the profile edge. Flexible sanding strips are then removably attached about the outer surfaces of the backing portions of each of the sanding members. The flexible sanding strips assume the shape of the outer surface of each backing portion which, in turn, corresponds to one of the surfaces of the profile to be sanded. The separate sanding members are secured to the drive means in a stacked relationship with their separate sanding strips abutting one another to form an edge. The edge is relatively sharp and corresponds to the sharp edge of the profile formed where the first and second surfaces of the wooden panel's profile meet. In this manner, the sanding wheel assumes a profile corresponding to the radical profile of the wooden panel and does so using relatively inexpensive and easily removable and replaceable sanding strips.

BRIEF DESCRIPTION OF THE DRAWINGS

FIG. 4 is a top plan view of the assembled sanding wheel.

FIG. 5 is a cross-sectional view taken along line 5—5 of FIG. 4 showing the upper and lower sanding members as they are stacked on top of one another.

FIG. 6 is a cross-sectional view similar to FIG. 5 but of a prior art, single-piece sanding wheel using a single sanding strip to cover the entire height of the radical or sharp profile. FIG. 6 illustrates the difficulty in achieving a sharp edge between the angled surfaces of the sanding wheel profile with just a single strip of removable sandpaper covering the entire height of the profile.

DETAILED DESCRIPTION OF THE PREFERRED EMBODIMENTS

Figure 1:
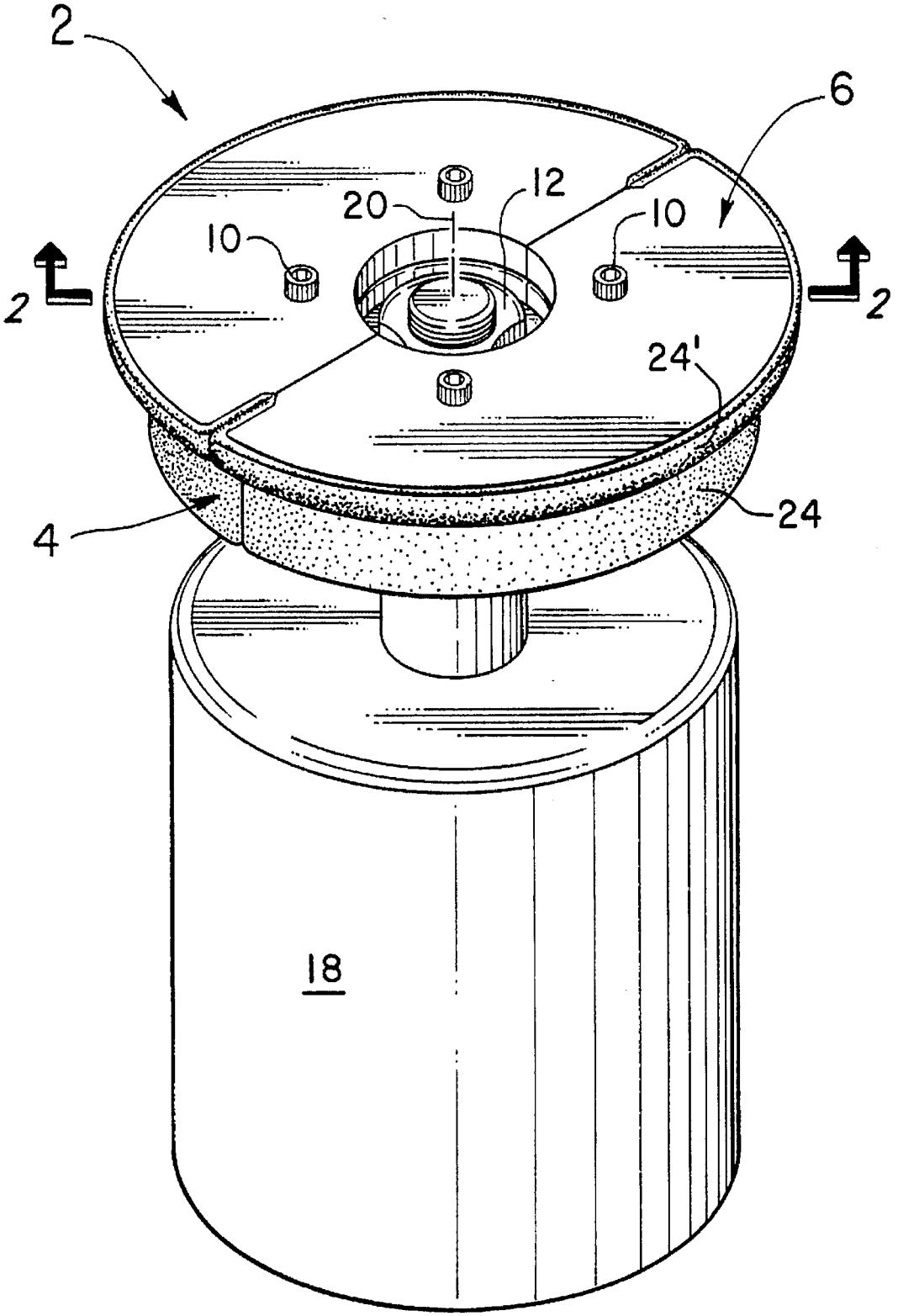
FIG. 1 is a perspective view of the stacked sanding wheel of the present invention.
Figure 2:
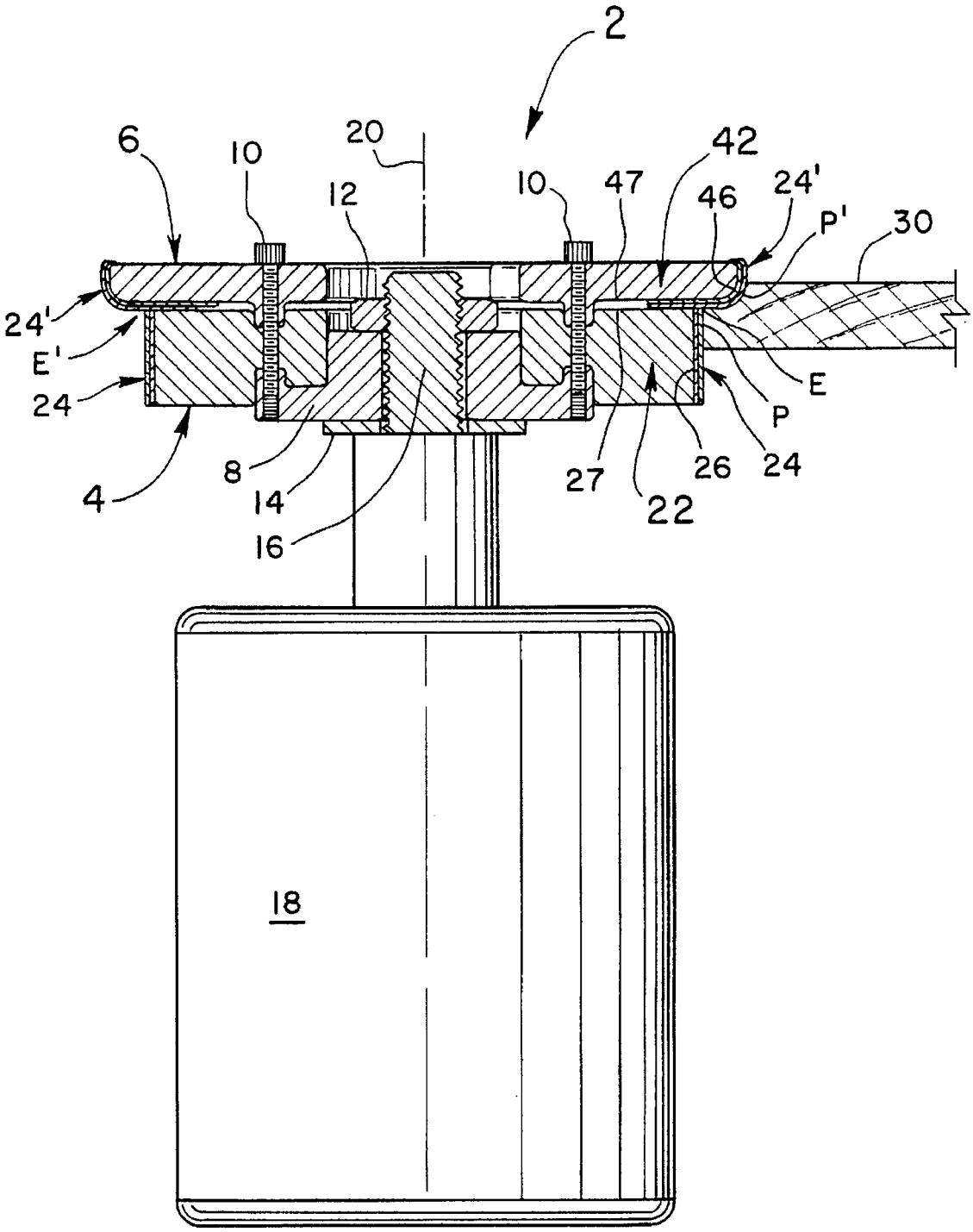
FIG. 2 is a cross-sectional view taken along line 2—2 of FIG. 1 and also showing the sanding wheel in use to sand the radical profile of a wooden panel.

As best seen in FIGS. 1 and 2, the stacked sanding wheel 2 of the present invention includes two sanding members 4 and 6. These bottom and top sanding members 4 and 6 (see FIG. 2) are stacked atop one another and are removably secured to each other and to the disc-shaped base support 8 by screws 10. The base support 8, in turn, is removably secured by nut 12 and washer 14 to and about the shaft 16 of the drive means 18. In this manner, the sanding wheel 2 is removably mounted to the drive means 18 for rotation about the axis 20.

Figure 3:
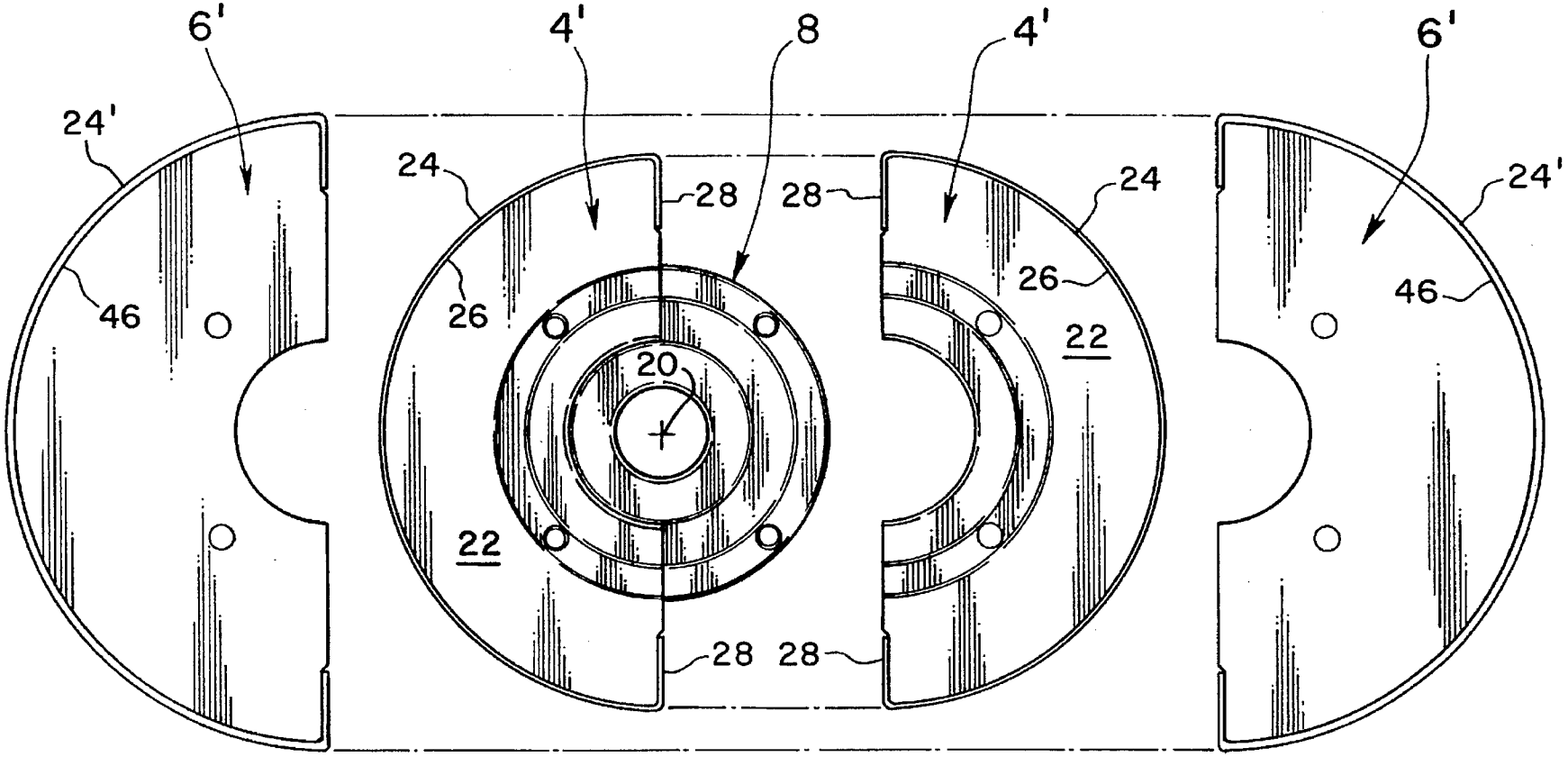
FIG. 3 is a partially exploded, top plan view of the sanding wheel.

The bottom or smaller diameter sanding member 4 as shown in FIG. 2 includes backing portion 22 and flexible sanding strip means 24. The sanding strip 24 is removably attached to and about the outer surface 26 of the backing portion 22. The backing portion 22 is preferably made of metal or other relatively rigid and inflexible material that will hold and maintain its shape during the sanding operation. The sanding member 4 itself as shown in the exploded view of FIG. 3 is preferably composed of two C-shaped sections 4' (but could be three or more pieces or even a single, unitary piece). Similarly, the sanding strip means 24 preferably has a separate or individual strip segment for each C-shaped backing portion 22 (see FIG. 3) with the segment ends 28 of each strip segment wrapped around the ends of each C-shape. However, if desired, the sanding strip means 24 could be a single strip or band wrapped completely about the assembled and abutting C-shaped back portion 22.

Regardless of whether the annular sanding member 4 is a unitary piece or made up of a number of separable pieces or sections, the outer surface 26 of the backing portions 22 of the assembled sanding member 4 is substantially continuous about the axis 20. Further, at least the part 26' (see FIG. 5) of the outer surface 26 of the backing portions 22 is profiled to match or correspond to one of the surfaces (e.g., the lower, straight surface E) of the profile P, P' of the wooden workpiece or panel 30. The flexible sanding strip means 24 with its outer, abrasive surface 32 can then be removably attached as a single piece directly to the backing surface 26 by glue or more preferably by the hook-loop arrangement of pieces 35 and 37 (see FIG. 5). In this preferred arrangement, hook piece 35 of the sanding strip means 24 is glued or otherwise attached to the backing surface 26 with the outer piece 37 of the sanding strip means 24 having a mating loop on it. The outer abrasive piece 37 of the sanding strip means 24 can then be easily and quickly removed and replaced as desired. In this manner, the abrasive outer surface 32 of the flexible sanding strip means 24 assumes the profile of the outer surface 26 of the backing portions 22. This outer surface 26, in turn, matches and corresponds (at least at the working part 26') to the profile of the surface E on the lower leg or side of the edge E (see FIG. 5) of the profile P, P' of panel 30.

Similarly, the second or upper sanding member 6 can be a single, unitary piece or made up of one or more sections such as the C-shaped sections 6' of FIG. 3. Regardless of whether the sanding member 6 is composed of one or more pieces or sections, the assembled sanding member 6 has a backing portion 42 and sanding strip means 24' attached thereto. Like sanding member 4, the abrasive portion of the sanding strip 24' is preferably removably attached (e.g., hook-loop arrangement) to and about the outer surface 46 of the backing portion 42. However, unlike lower sanding member 4, the outer surface 46 of the sanding member 6 (at least at part 46' in FIG. 5) is profiled to match and correspond to the upper surface P' on the other leg or side of edge E of the profile P, P' of panel 30.

In operation, the first and second sanding members 4 and 6 are first secured to the drive means 18 in the stacked relationship of FIG. 2. In doing so and as best seen in FIGS. 2 and 5, the sanding members 4 and 6 are positioned adjacent one another along the axis 20 (see FIG. 2) with their respective outer, abrasive surfaces 32 and 32' (FIG. 5) extending about and along the axis 20 and abutting one another. In this manner, the abutting sanding strips 24 and 24' form a relatively sharp edge E' matching or corresponding to the desired edge E of the panel 30 profile P, P' (see again FIG. 5). Since the sanding profile of the sanding wheel 2 is made up of two separate sanding strips 24 and 24', nearly any desired sharp edge at E' can be created. This is particularly true as shown in FIGS. 2 and 5 when the non-abrasive surface 38 or thickness of the side of piece 37 of the sanding strip means 24 is directly abutting against the sanding strip 24' and its abrasive surface 32'. As best illustrated in FIG. 5, the angle so created results in a linear edge E' with no gap or spacing between the abrasive surfaces 32 and 32'. The profile surfaces P and P' of the panel 30 can then be sanded virtually to the linear edge E' formed where straight surface P and curved surface P' meet.

This degree of sharpness at the sanding edge E' is preferably achieved by extending a part 25 of the sanding strip means 24' on member 6 inwardly of the edge E' (i.e., to the left in FIG. 5) over surface 47 of backing portion 42. Consequently, when the sanding wheel 2 is assembled (see FIGS. 2 and 5), this part 25 of the sanding strip 24' is then pinched between the outwardly extending surfaces 27 and 47 of the backing portions 22 and 42 of sanding members 4 and 6. That is, as shown in FIGS. 2 and 5, the surfaces 27 and 47 extend outwardly of and substantially perpendicular to the axis 20 (FIG. 2) and substantially abut one another. In use, the part 25 of the sanding strip means 24' is then substantially pinched and held in place between surfaces 27 and 47. As stated above, this helps to create and to maintain in use a clean and sharp edge E' between the abutting, abrasive outer surfaces 32 and 32' of the sanding strips 24 and 24'.

Figure 7:
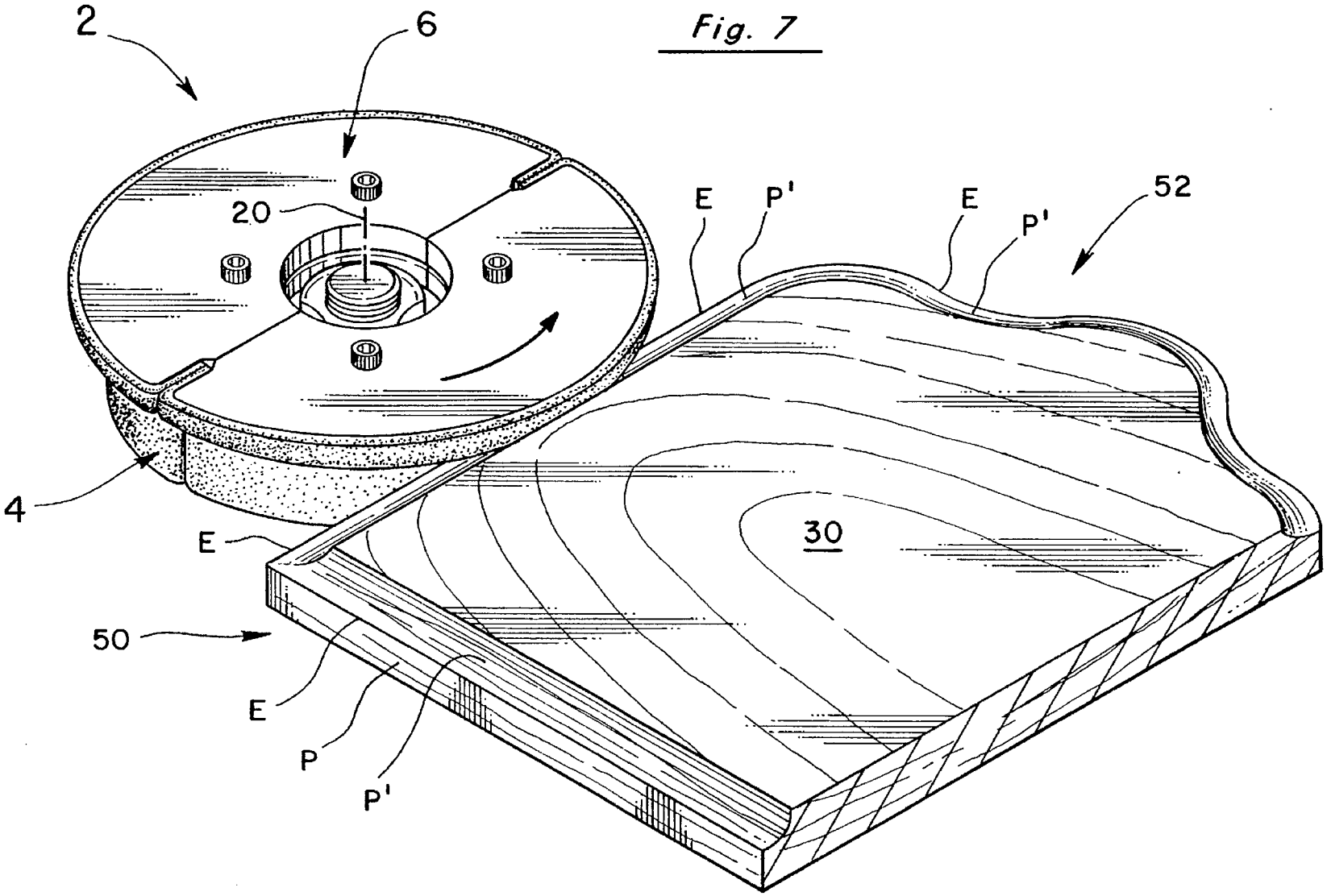
FIG. 7 illustrates the stacked sanding wheel of the present invention in use to sand the radical profiles of a wooden panel.

This edge E' as illustrated in FIG. 5 is essentially a linear edge in contrast to, for example, the radius or curved "edge" E" of the prior art approach of FIG. 6. That is, if a continuous strip of sandpaper such as 1 in FIG. 6 is applied directly (or by a hook-loop arrangement) along the entire height of the profile of the backing portion 3, the strip 1 cannot be effectively bent or pushed into the sharp angle of the radical edge 5 between surfaces 7 and 9. Rather, the strip 1 ends up curving (see again FIG. 6) across the angle between surfaces 5 and 7 thereby dulling or putting an undesirable radius or curve on the sharp linear edge E of the panel 30 to be sanded. In contrast, the use of two separate sanding strips 24 and 24' on separate, stacked sanding members 4 and 6 as disclosed above overcomes this problem. Additionally, as illustrated in FIGS. 5 and 7, the sharp edge E' of the sanding wheel 2 can be used to sand radical profiles on both straight sides 50 and curved sides 52 of the workpiece or panel 30. In other words, the linear edge E of the panel 30 can be one that extends along or about the panel 30 either as a straight linear edge (side 50) or a curved linear edge (side 52) and the sanding wheel 2 of the present invention can be used to sand both types of radical profiles.

While several embodiments of the present invention have been shown and described in detail, it is to be understood that various modifications and changes could be made to them without departing from the spirit of the invention. For example, the invention of FIGS. 1–7 has been shown and described with the profile of the outer surface 26 of the member 4 being substantially cylindrical about axis 20 and the profile of sanding member 6 extending along the axis 20 in a curve. This results in the very common and popular radical profile E, E' but the individual profiles of the sanding members 4 and 6 could obviously be varied. The sanding member 4 is also preferably distinct from the base support member 8 but could be integral therewith if desired. Preferably, the sanding wheel components are distinct adding to the ease of assembly, disassembly, and individual component replacement, all of which are critical to an efficient and cost effective operation. The larger diameter sanding member 6 is also shown as being on the top but it could obviously be on the bottom and its diameter varied as desired. Each sanding member 4 and 6 of the preferred embodiment is shown and described as being two, substantially identical C-shaped or arcuate sections extending respectively 180 degrees about the axis 20; but, the annular ring or other arrangement formed by them could be divided into any number of a plurality of identical or non-identical sections or parts which were attached individually or collectively to the support member 8.

We claim:

1. A multi-piece sanding wheel primarily intended for sanding a profile of a workpiece, said workpiece profile having first and second surfaces meeting substantially at an angle of 90° to form a substantially sharp, linear edge, said multi-piece sanding wheel including:

first and second sanding members, drive means for rotating said first and second sanding members about an axis, and means for removably securing said first and second sanding members to said drive means in a stacked relationship for rotation about said axis, said first sanding member including a substantially rigid backing portion with an outer surface extending substantially continuously about and along said axis of rotation, at least a part of said outer surface of said backing portion matching and corresponding in profile to the first surface of the workpiece profile to be sanded, said first sanding member further including a flexible sanding strip means with an abrasive, outer surface and means for removably attaching said flexible sanding means to and about at least the part of the outer surface of said backing portion matching and corresponding to the first surface of the workpiece profile to be sanded wherein said abrasive, outer surface of said flexible sanding strip means assumes the profile of said part of the outer surface of the backing portion and the first surface of the workpiece profile to be sanded, said second sanding member including a substantially rigid backing portion with an outer surface extending substantially continuously about and along said axis of rotation, at least a part of said outer surface of said backing portion matching and corresponding in profile to the second surface of the workpiece profile to be sanded, said second sanding member further including a flexible sanding strip means with an abrasive, outer surface and means for removably attaching said flexible sanding means to and about at least the part of the outer surface of said backing portion matching and corresponding to the second surface of the workpiece profile to be sanded wherein said abrasive, outer surface of said flexible sanding strip means assumes the profile of said part of the outer surface of the backing portion and the second surface of the workpiece profile to be sanded, and said means for removably securing said first and second sanding members to said drive means in said stacked relationship includes means for removably positioning said first and second sanding members adjacent one another along said axis with said parts of said outer surfaces of said backing portions thereof substantially meeting one another substantially at said angle and with said abrasive, outer surfaces of the respective sanding strip means of said first and second sanding members abutting one another substantially at said angle to form a relatively sharp edge corresponding to the edge of the workpiece profile formed where said first and second surfaces of said workpiece profile meet.

2. A multi- piece sanding wheel primarily intended for sanding a profile of a workpiece, said workpiece profile having first and second surfaces meeting to form a substantially sharp linear edge, said multi-piece sanding wheel including first and second sanding members, drive means for rotating said first and second sanding members about an axis, and means for removably securing said first and second sanding members to said drive means in a stacked relationship for rotation about said axis, said first sanding member including a substantially rigid backing portion with an outer surface extending substantially continuously about and along said axis of rotation, at least a part of said outer surface of said backing portion matching and corresponding in profile to the first surface of the workpiece profile to be sanded, said first sanding member further including a flexible sanding strip means with an abrasive, outer surface and means for removably attaching said flexible sanding means to and about at least the part of the outer surface of said backing portion matching and corresponding to the first surface of the workpiece profile to be sanded wherein said abrasive, outer surface of said flexible sanding strip means assumes the profile of said part of the outer surface of the backing portion and the first surface of the workpiece profile to be sanded, said second sanding member including a substantially rigid backing portion with an outer surface extending substantially continuously about and along said axis of rotation, at least a part of said outer surface of said backing portion matching and corresponding in profile to the second surface of the workpiece profile to be sanded, said second sanding member further including a flexible sanding strip means with an abrasive, outer surface and means for removably attaching said flexible sanding means to and about at least the part of the outer surface of said backing portion matching and corresponding to the second surface of the workpiece profile to be sanded wherein said abrasive, outer surface of said flexible sanding strip means assumes the profile of said part of the outer surface of the backing portion and the second surface of the workpiece profile to be sanded, and said means for removably securing said first and second sanding members to said drive means in said stacked relationship includes means for removable positioning said first and second sanding members adjacent one another along said axis with said abrasive, outer surfaces of the respective sanding strip means of said first and second sanding members abutting one another to form a relatively sharp edge corresponding to the edge of the workpiece profile formed where said first and second surfaces of said workpiece profile meet wherein each of said backing portions of said first and second sanding members has a surface extending outwardly of and substantially perpendicular to said axis when said first and second sanding members are secured to said drive means, said outwardly extending surfaces substantially abutting one another wherein only one of said sanding strip means of said first and second sanding members has a part thereof extending between and being substantially pinched between said substantially abutting, outwardly extending surfaces of said backing portions.

3. A multi-piece sanding wheel primarily intended for sanding a profile of a workpiece, said workpiece profile having first and second surfaces meeting to form a substantially sharp, linear edge, said multi-piece sanding wheel including:

first and second sanding members, drive means for rotating said first and second sanding members about an axis, and means for removable securing said first and second sanding members to said drive means in a stacked relationship for rotation about said axis, said first sanding member including a substantially rigid backing portion with an outer surface extending substantially continuously about and along said axis of rotation, at least a part of said outer surface of said backing portion matching and corresponding in profile to the first surface of the workpiece profile to be sanded, said first sanding member further including a flexible sanding strip means with an abrasive, outer surface and means for removably attaching said flexible sanding means to and about at least the part of the outer surface of said backing portion matching and corresponding to the first surface of the workpiece profile to be sanded wherein said abrasive, outer surface of said flexible sanding strip means assumes the profile of said part of the outer surface of the backing portion and the first surface of the workpiece profile to be sanded, said second sanding member including a substantially rigid backing portion with an outer surface extending substantially continuously about and along said axis of rotation, at least a part of said outer surface of said backing portion matching and corresponding in profile to the second surface of the workpiece profile to be sanded, said second sanding member further including a flexible sanding strip means with an abrasive outer surface and means for removably attaching said flexible sanding means to and about at least the part of the outer surface of said backing portion matching and corresponding to the second surface of the workpiece profile to be sanded wherein said abrasive, outer surface of said flexible sanding strip means assumes the profile of said part of the outer surface of the backing portion and the second surface of the workpiece profile to be sanded, and said means for removable securing said first and second sanding members to said drive means in said stacked relationship includes means for removably positioning said first and second sanding members adjacent one another along said axis with said abrasive, outer surfaces of the respective sanding strip means of said first and second sanding members abutting one another to form a relatively sharp edge corresponding to the edge of the workpiece profile formed where said first and second surfaces of said work piece profile meet wherein said flexible sanding strip means of said first sanding member has a side with a non-abrasive surface extending inwardly from the abrasive, outer surface of said sanding strip means and toward said axis, and said positioning means removably positions said non-abrasive surface of said side of said sanding strip means of said first sanding member in an abutting relationship against the flexible sanding strip means of said second sanding means.

4. The multi-piece sanding wheel of claim 3 wherein said non-abrasive surface of the said sanding strip means of first sanding member is positioned against and abuts the abrasive surface of the sanding strip means of said second sanding member.

5. The multi-piece sanding wheel of claim 1 wherein the outer surface of the backing portion of at least one of said first and second sanding members is substantially cylindrical about said axis.

6. The multi-piece sanding wheel of claim 5 wherein the profile of the outer surface of the backing portion of the other of said first and second sanding members extends along said axis in a curve.

7. The multi-piece sanding wheel of claim 1 wherein at least one of said abrasive, outer surfaces of said first and second sanding members extends away from abutting with the other of said abrasive, outer surfaces in a direction substantially parallel to said rotational axis.

8. The multi-piece sanding wheel of claim 7 wherein the other of said abrasive, outer surfaces extends away from abutting with the one of said abrasive, outer surfaces in a direction substantially perpendicular to said rotational axis.

9. The multi-piece sanding wheel of claim 1 wherein the backing portion of said first sanding member includes at least two sections wherein each of said sections is a part of a substantially annular ring extending about said axis.

10. The multi-piece sanding wheel of claim 9 wherein each section is substantially C-shaped.

11. The multi-piece sanding wheel of claim 9 wherein the backing portion of said second sanding member includes at least two sections wherein each section is a part of a substantially annular ring extending about said axis.

12. The multi-piece sanding wheel of claim 11 wherein each part of said backing portion of said second member is substantially C-shaped.

13. The multi-piece sanding wheel of claim 1 wherein the backing portion of said first sanding member has at least two sections, the sanding strip means of said first sanding member has at least two strip segments, and said attaching means of said first sanding member respectively removably attaches each sanding strip segment to each backing portion section.

14. The multi-piece sanding wheel of claim 1 wherein the backing portion of said first sanding member includes a plurality of separable sections, each of said sections forming a part of said substantially continuous outer surface of said first sanding member wherein said sections together form said substantially continuous outer surface of said first sanding member.

15. The multi-piece sanding wheel of claim 14 wherein the backing portion of said second sanding member includes a plurality of separable sections, each of said sections forming a part of said substantially continuous outer surface of said second sanding member wherein said sections together form said substantially continuous outer surface of said second sanding member.

16. The sanding wheel of claim 14 wherein each of said plurality of sections of the backing portion of said first sanding member is a portion of a substantially annular ring spaced from and extending about said axis when said first sanding member is secured to said drive means.

17. The sanding wheel of claim 16 wherein the backing portion of said second sanding member includes a plurality of sections, each of said plurality of sections of the backing portion of said second sanding member being a portion of a substantially annular ring spaced from and extending about said axis when said second sanding member is secured to said drive means.

18. A multi-piece sanding wheel primarily intended for sanding a profile of a workpiece, said workpiece profile having first and second surfaces meeting to form a substantially sharp, linear edge, said multi-piece sanding wheel including:

first and second sanding members, drive means for rotating said first and second sanding members about an axis, and means for removably securing said first and second sanding members to said drive means in a stacked relationship for rotation about said axis, said first sanding member including a substantially rigid backing portion with an outer surface extending substantially continuously about and along said axis of rotation, at least a part of said outer surface of said backing portion matching and corresponding in profile to the first surface of the workpiece profile to be sanded, said first sanding member further including a flexible sanding strip means with an abrasive, outer surface and means for removably attaching said flexible sanding means to and about at least the part of the outer surface of said backing portion matching and corresponding to the first surface of the workpiece profile to be sanded wherein said abrasive, outer surface of said flexible sanding strip means assumes the profile of said part of the outer surface of the backing portion and the first surface of the workpiece profile to be sanded, said second sanding member including a substantially rigid backing portion with an outer surface extending substantially continuously about and along said axis of rotation, at least a part of said outer surface of said backing portion matching and corresponding in profile to the second surface of the workpiece profile to be sanded, said second sanding member further including a flexible sanding strip means with an abrasive, outer surface and means for removably attaching said flexible sanding means to and about at least the part of the outer surface of said backing portion matching and corresponding to the second surface of the workpiece profile to be sanded wherein said abrasive, outer surface of said flexible sanding strip means assumes the profile of said part of the outer surface of the backing portion and the second surface of the workpiece profile to be sanded, and said means for removably securing said first and second sanding members to said drive means in said stacked relationship includes means for removably positioning said first and second sanding members adjacent one another along said axis with said abrasive, outer surfaces of the respective sanding strip means of said first and second sanding members abutting one another to form a relatively sharp edge corresponding to the edge of the workpiece profile formed where said first and second surfaces of said workpiece profile meet and wherein at least one of said abrasive, outer surfaces of said first and second sanding members extends away from abutting with the other of said abrasive, outer surfaces in a direction substantially parallel to said rotational axis.

19. The multi-piece sanding wheel of claim 18 wherein the other of said abrasive, outer surfaces extends away from abutting with the one of said abrasive, outer surfaces in a direction substantially perpendicular to said rotational axis.

20. The multi-piece sanding wheel of claim 18 wherein each of said backing portions of said first and second sanding members has a surface extending outwardly of and substantially perpendicular to said axis when said first and second sanding members are secured to said drive means, said outwardly extending surfaces substantially abutting one another wherein only one of said sanding strip means of said first and second sanding members has a part thereof extending between said substantially abutting, outwardly extending surfaces of said backing portions.

21. A multi-piece sanding wheel primarily intended for sanding a profile of a workpiece, said workpiece profile having first and second surfaces meeting to form a substantially sharp, linear edge, said multi-piece sanding wheel including:

first and second sanding members, drive means for rotating said first and second sanding members about an axis, and means for removably securing said first and second sanding members to said drive means in a stacked relationship for rotation about said axis, said first sanding member including a substantially rigid backing portion with an outer surface extending substantially continuously about and along said axis of rotation, at least a part of said outer surface of said backing portion matching and corresponding in profile to the first surface of the workpiece profile to be sanded, said first sanding member further including a flexible sanding strip means with an abrasive, outer surface and means for removably attaching said flexible sanding means to and about at least the part of the outer surface of said backing portion matching and corresponding to the first surface of the workpiece profile to be sanded wherein said abrasive, outer surface of said flexible sanding strip means assumes the profile of said part of the outer surface of the backing portion and the first surface of the workpiece profile to be sanded, said second sanding member including a substantially rigid backing portion with an outer surface extending substantially continuously about and along said axis of rotation, at least a part of said outer surface of said backing portion matching and corresponding in profile to the second surface of the workpiece profile to be sanded, said second sanding member further including a flexible sanding strip means with an abrasive, outer surface and means for removably attaching said flexible sanding means to and about at least the part of the outer surface of said backing portion matching and corresponding to the second surface of the workpiece profile to be sanded wherein said abrasive, outer surface of said flexible sanding strip means assumes the profile of said part of the outer surface of the backing portion and the second surface of the workpiece profile to be sanded, and said means for removably securing said first and second sanding members to said drive means in said stacked relationship includes means for removably positioning said first and second sanding members adjacent one another along said axis with said abrasive, outer surfaces of the respective sanding strip means of said first and second sanding members abutting one another to form a relatively sharp edge corresponding to the edge of the workpiece profile formed where said first and second surfaces of said workpiece profile meet wherein each of said backing portions of said first and second sanding members has a surface extending outwardly of and substantially perpendicular to said axis when said first and second sanding members are secured to said drive means, said outwardly extending surfaces substantially abutting one another wherein only one of said sanding strip means of said first and second sanding members has a part thereof extending between said substantially abutting, outwardly extending surfaces of said backing portions.

22. The multi-piece sanding wheel of claim 21 wherein the flexible sanding strip means of said second sanding member has said part extending between said substantially abutting, outwardly extending surfaces of said backing portions and said flexible sanding strip means of said first sanding member has a side with a surface extending inwardly from the abrasive, outer surface of said sanding strip means and toward said axis, and said positioning means removably positions said surface of said side of said sanding strip means of said first sanding member in an abutting relationship against the flexible sanding strip means of said second sanding means.

* * * * *